US007922054B2

(12) United States Patent
Cole, Jr.

(10) Patent No.: US 7,922,054 B2
(45) Date of Patent: Apr. 12, 2011

(54) NAIL GUN WITH INTEGRATED SAFETY DEVICE

(75) Inventor: Steven Wynne Cole, Jr., Lombard, IL (US)

(73) Assignee: Robert Bosch GmbH, Stuttgart (DE)

( * ) Notice: Subject to any disclaimer, the term of this patent is extended or adjusted under 35 U.S.C. 154(b) by 192 days.

(21) Appl. No.: 12/235,848

(22) Filed: Sep. 23, 2008

(65) Prior Publication Data

US 2010/0072247 A1 Mar. 25, 2010

(51) Int. Cl.
*B25C 1/06* (2006.01)

(52) U.S. Cl. ..... 227/8; 227/123; 227/129

(58) Field of Classification Search ..... 227/8, 123, 227/156, 107, 129
See application file for complete search history.

(56) References Cited

U.S. PATENT DOCUMENTS

| | | | | | |
|---|---|---|---|---|---|
| 3,011,169 | A | | 12/1961 | Cast et al. | |
| 3,273,777 | A | | 9/1966 | Juilfs et al. | |
| 3,570,738 | A | * | 3/1971 | Pabich et al. | 227/8 |
| 4,121,745 | A | | 10/1978 | Smith et al. | |
| 4,197,974 | A | * | 4/1980 | Morton et al. | 227/8 |
| 4,389,012 | A | * | 6/1983 | Grikis et al. | 227/120 |
| 4,404,894 | A | * | 9/1983 | Oesterle | 91/461 |
| 4,405,071 | A | * | 9/1983 | Austin | 227/7 |
| 4,436,236 | A | | 3/1984 | Jobe | |
| 4,549,681 | A | | 10/1985 | Yamamoto et al. | |
| 4,629,106 | A | * | 12/1986 | Howard et al. | 227/8 |
| 4,821,937 | A | * | 4/1989 | Rafferty | 227/8 |
| 5,261,587 | A | * | 11/1993 | Robinson | 227/8 |
| 5,350,103 | A | * | 9/1994 | Monacelli | 227/8 |
| 5,642,849 | A | | 7/1997 | Chen | |
| 5,649,660 | A | * | 7/1997 | Akiba et al. | 227/8 |
| 5,662,257 | A | * | 9/1997 | Mukoyama et al. | 227/8 |
| 5,862,969 | A | * | 1/1999 | Lee | 227/8 |
| 6,209,770 | B1 | * | 4/2001 | Perra | 227/8 |
| 6,318,618 | B1 | | 11/2001 | Jen | |
| 6,427,896 | B1 | * | 8/2002 | Ho et al. | 227/142 |
| 6,592,014 | B2 | * | 7/2003 | Smolinski | 227/8 |
| 6,763,989 | B2 | | 7/2004 | Wang | |
| 6,908,021 | B1 | * | 6/2005 | Wang | 227/8 |
| 6,929,165 | B1 | * | 8/2005 | Chen et al. | 227/8 |
| 7,143,918 | B2 | * | 12/2006 | Aguirre et al. | 227/8 |
| 7,413,103 | B1 | * | 8/2008 | Ho et al. | 227/8 |
| 7,458,492 | B2 | * | 12/2008 | Terrell et al. | 227/8 |
| 7,464,843 | B2 | * | 12/2008 | Huang | 227/8 |
| 7,484,647 | B2 | * | 2/2009 | Yang | 227/8 |
| 7,506,787 | B2 | * | 3/2009 | Wu et al. | 227/8 |
| 2004/0084499 | A1 | | 5/2004 | Tsai | |
| 2006/0191973 | A1 | | 8/2006 | Chen et al. | |
| 2009/0108046 | A1 | * | 4/2009 | Huang | 227/8 |
| 2009/0250498 | A1 | * | 10/2009 | Chen et al. | 227/8 |

* cited by examiner

*Primary Examiner* — Brian D Nash
(74) *Attorney, Agent, or Firm* — Maginot, Moore & Beck

(57) ABSTRACT

A device for impacting a fastener in one embodiment includes a trigger. A trigger disabling mechanism changeable between a first condition wherein operation of the trigger is not disabled and a second condition wherein operation of the trigger is disabled is also included. The device includes a nose piece configured to change the trigger disabling mechanism from the second condition to the first condition. The nose piece includes including a first nose portion removably coupled to a second nose portion. The first nose portion and the second nose portion define a channel therebetween through which a fastener is driven.

17 Claims, 5 Drawing Sheets

NAIL GUN WITH INTEGRATED SAFETY DEVICE

FIELD OF THE INVENTION

This invention relates to the field of devices used to drive fasteners into work-pieces and particularly to a device for impacting fasteners into work pieces.

BACKGROUND

Fasteners such as nails and staples are commonly used in projects ranging from crafts to building construction. While manually driving such fasteners into a work piece is effective, a user may quickly become fatigued when involved in projects requiring a large number of fasteners and/or large fasteners to be driven into a work piece. Moreover, proper driving of larger fasteners into a work piece frequently requires more than a single impact from a manual tool.

In response to the shortcomings of manual driving tools, power-assisted devices for driving fasteners into work pieces have been developed. Contractors and homeowners commonly use such devices for driving fasteners ranging from brad nails used in small projects to common nails which are used in framing and other construction projects. Compressed air has been traditionally used to provide power for the power-assisted (pneumatic) devices.

Various safety features have been incorporated into pneumatic and other power nailers. One such device is commonly referred to as a work contact element (WCE). A WCE is incorporated into nail gun designs to prevent unintentional firing of the nail gun. A WCE is typically a spring loaded mechanism which extends forwardly of the portion of the nail gun from which a nail is driven. In operation, the WCE is pressed against a work piece into which a nail is to be driven. As the WCE is pressed against the work piece, the WCE compresses the spring and generates an axial movement which is transmitted to a trigger assembly. The axial movement is used to reconfigure a safety device, also referred to as a trigger disabling mechanism, so as to enable initiation of a firing sequence with the trigger of the nail gun.

While the use of a WCE is very effective in preventing inadvertent firing of a nail gun, the location of the WCE can be problematic. Specifically, the WCE blocks the view that an operator has of the location on the work piece into which a nail or other fastener is to be driven. For projects which require fasteners to be driven into precise locations, the visual interference caused by the WCE can result in inaccurate placement of the fastener in the work piece.

What is needed is a safety system which can be used to prevent inadvertent nail gun firing while providing an operator with an unobstructed view of the location into which a fastener is to be driven. What is further needed is a system which provides easy access for clearing jams in the nail drive channel.

SUMMARY

In accordance with one embodiment, there is provided a device for impacting a fastener which in one embodiment includes a trigger, a trigger disabling mechanism changeable between a first condition wherein operation of the trigger is not disabled and a second condition wherein operation of the trigger is disabled, and a nose piece configured to change the trigger disabling mechanism from the second condition to the first condition, the nose piece including a first nose portion removably coupled to a second nose portion, the first nose portion and the second nose portion defining a channel therebetween through which a fastener is driven.

In accordance with another embodiment, a device for impacting a fastener includes a nose assembly with a base portion, a first nose section configured to be slidably positioned on the base portion, and a second nose section removably coupled to the first nose section, the first nose section and the second nose section defining a path along which a fastener is driven by the device, a trigger mechanism for initiating a firing sequence, and a trigger disabling mechanism for disabling the trigger mechanism, the trigger disabling mechanism responsive to the position of the first nose section, such that when the first nose section is in a first position the trigger disabling mechanism disables the trigger mechanism and when the first nose section is in a second position the trigger disabling mechanism does not disable the trigger mechanism.

In accordance with a further embodiment, a method of impacting a fastener includes removably coupling a first nose section and a second nose section, forming an angle with an arm of a lever and the upper surface of the first nose section, moving the coupled nose sections from a first position to a second position whereat a first surface of a spreader is in contact with the arm and a second surface of the spreader is in contact with the upper surface of the first nose section, enabling operation of a trigger when the coupled nose sections are in the second position, and forcing a fastener along a channel formed by the coupled nose sections.

DESCRIPTION

Figure 1:
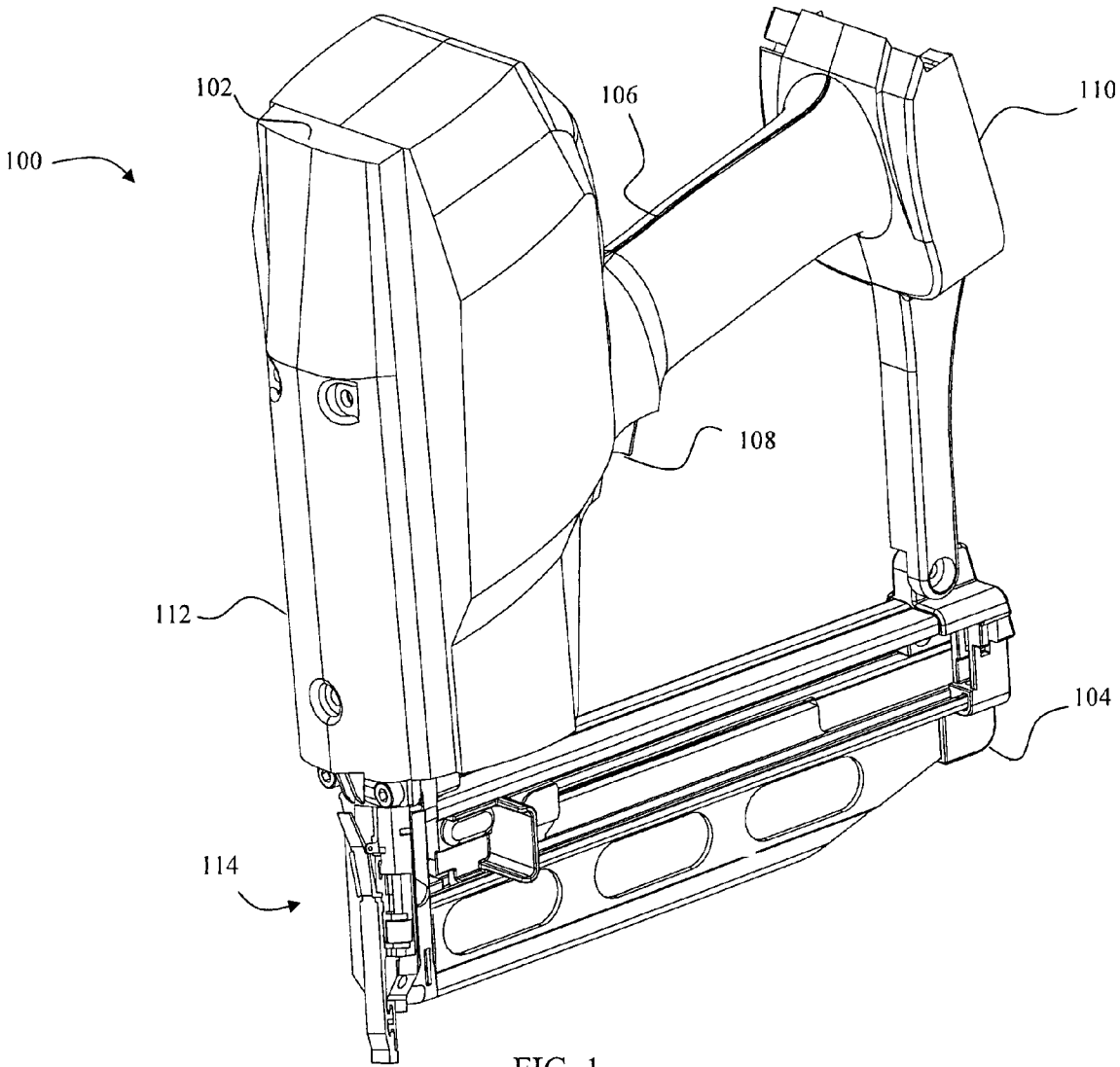
FIG. 1 depicts a side perspective view of a fastener impacting device in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

FIG. 1 depicts a fastener impacting device 100 including a housing 102 and a fastener cartridge 104. The housing 102 defines a handle portion 106 from which a trigger 108 extends, a receptacle area 110 and a drive section 112. The fastener cartridge 104 in this embodiment is spring biased to force fasteners, such as nails or staples, serially one after the other, into a loaded position adjacent the drive section 112. The receptacle area 110 may be used to connect a source of compressed air or other source of power to the fastener impacting device 100.

Figure 2:
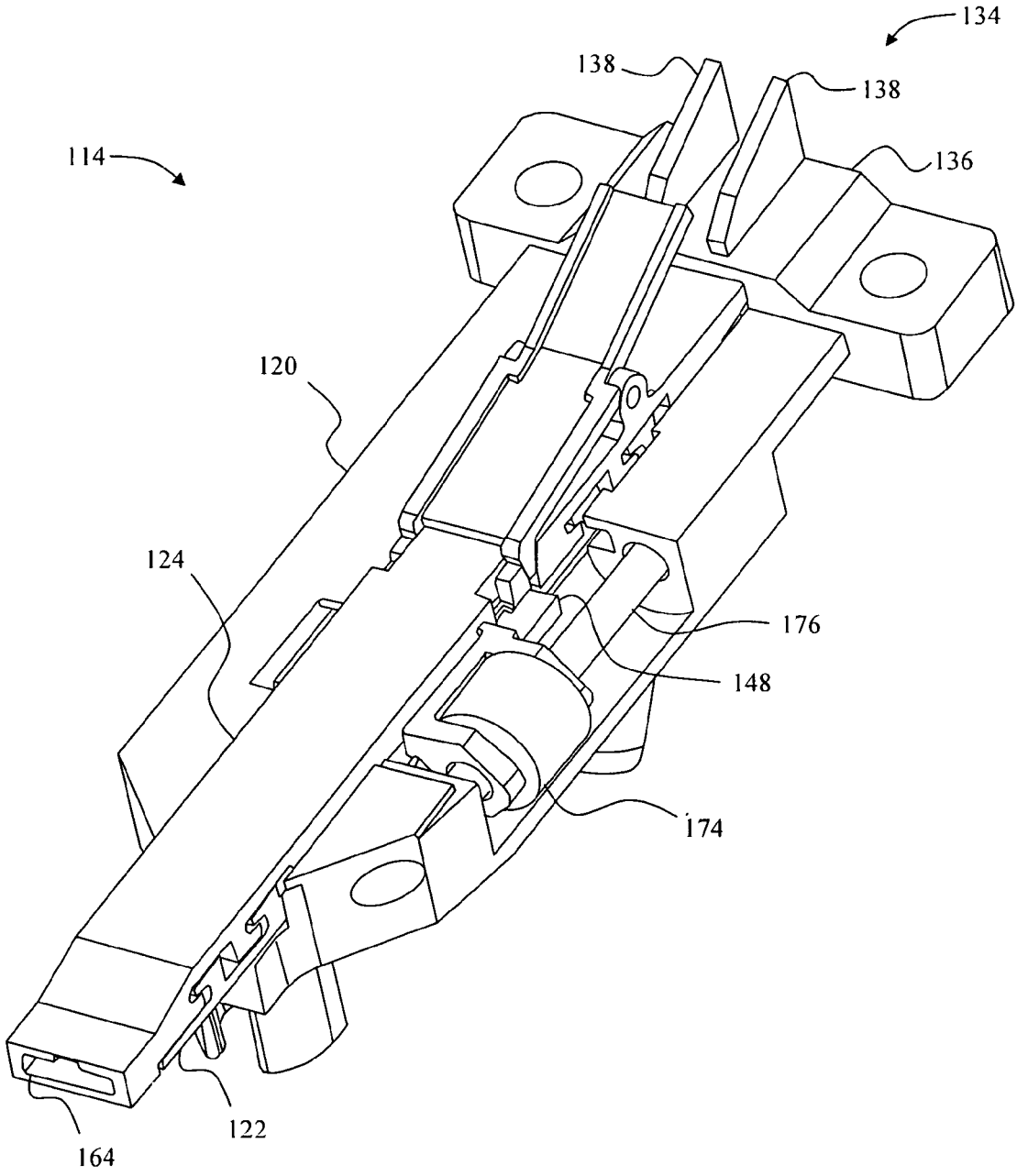
FIG. 2 depicts a top perspective view of the nose assembly of the fastener impacting device of FIG. 1.

Located adjacent to the drive portion 112 is a nose assembly 114. Referring to FIG. 2, the nose assembly 114 includes a base 120, a lower nose section 122 and an upper nose section 124. The base 120 includes a bed 126 shown in FIG. 3. Two guide rails 128 and 130 extend along the bed 126 and through an opening 132 defined in part by a spreader 134. The spreader 134 includes a lower portion 136 and a pair of ramps 138 which extend upwardly from the lower portion 136 and increase in height from the forward portion of the ramps 138 to the rear portion of the ramps 138. A pair of spring wells 140 are positioned at the bottom of the bed 126 and a pair of guide channels 142 (only one is sown in FIG. 2) are located adjacent to, and on the opposite sides of, the bed 126.

The lower nose section 122 includes a number of forward facing wedges 144 and a pair of wedge walls 146. A pair of guides 148 and a bracket 150 are located at the sides of the lower nose section 122. A spring stop 152 is located on the bottom of the lower nose section 122 which may be shaped complementary to the guide rails 128 and 130.

The upper nose section 124 includes a number of rearward facing wedges 154 and a pair of wedge walls 156. A bracket 158 is located on the upper surface of the rearward end portion 160 of the upper nose section 124. The forward end portion 162 defines a channel port 164.

Figure 3:
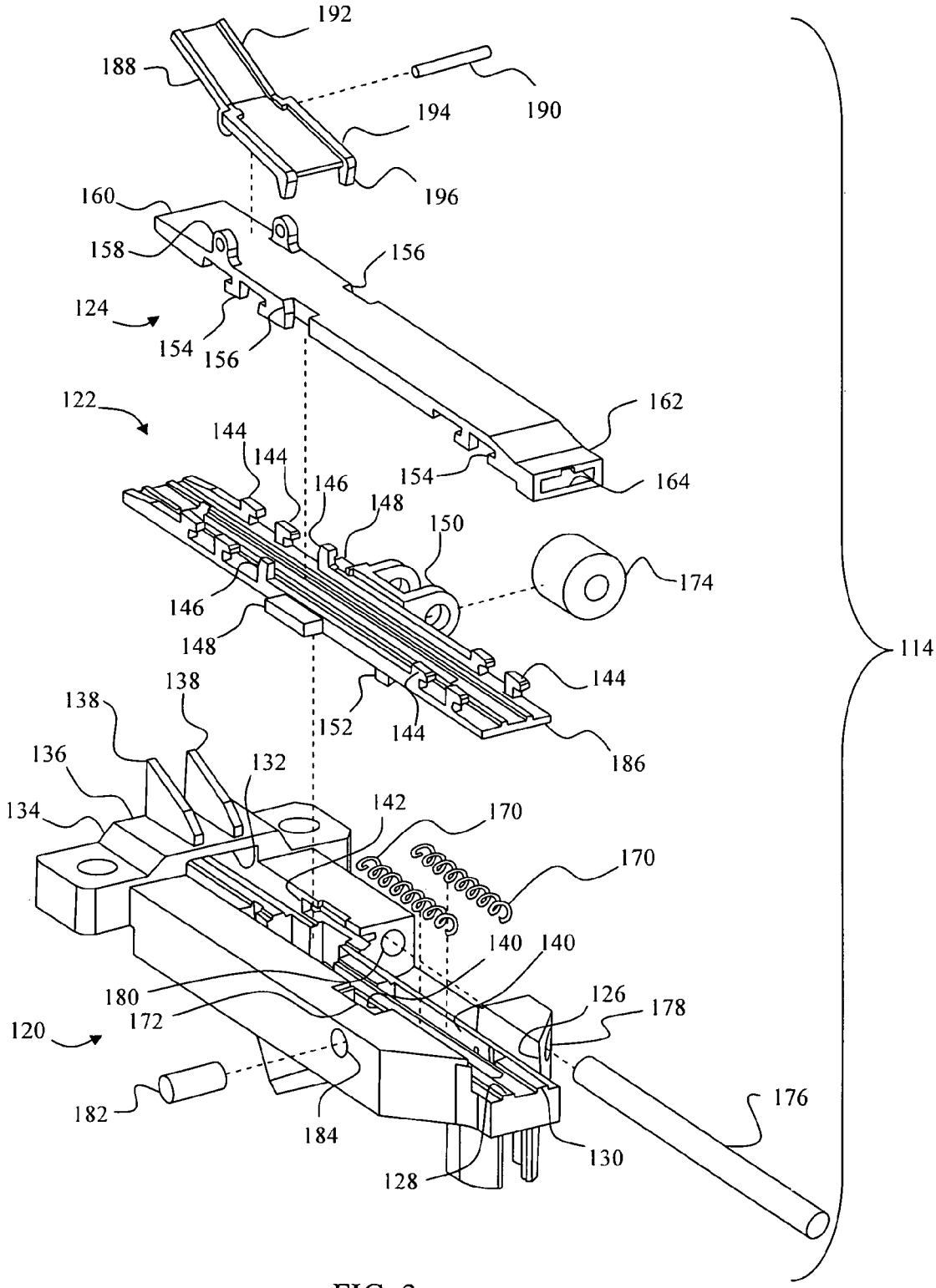
FIG. 3 depicts an exploded perspective view of the nose assembly of FIG. 2.

The remaining components of the nose assembly 114 shown in FIG. 3 are identified with reference to assembly of the nose assembly 114. Initially, two springs 170 are positioned in the spring wells 140. The lower nose section 122 is then placed on the bed 126 by aligning one of the guides 148 with a slot 172. A depth control nut 174 is positioned within the bracket 150 and a guide rod 176 is inserted through a first guide bore 178, the bracket 150, and the depth control nut 174 and into a second guide bore 180. At this point, the guides 148 are aligned with the guide channels 142.

The lower nose section 122 is then moved slightly rearwardly (toward the ramps 138) which brings the spring stop 152 into contact with the springs 170. Additionally, one of the guides 148 moves partially into one of the guide channels 142. Insertion of the pin 182 into the pin hole 184 prevents the lower nose section 122 from moving forwardly to a location whereat the guide 148 nearest to the pin would no longer be within the guide channel 142 and aligned with the slot 172. With the exception of the biasing force of the springs 170, however, the lower nose section 122 is free to move rearwardly into the opening 132. Thus, the lower nose section 122 is slidingly maintained on the bed 126 by a guide 148 located within a guide channel 142 on one side and by the bracket 150 which is slidably constrained by the guide rod 176 on the other side.

Figure 4:
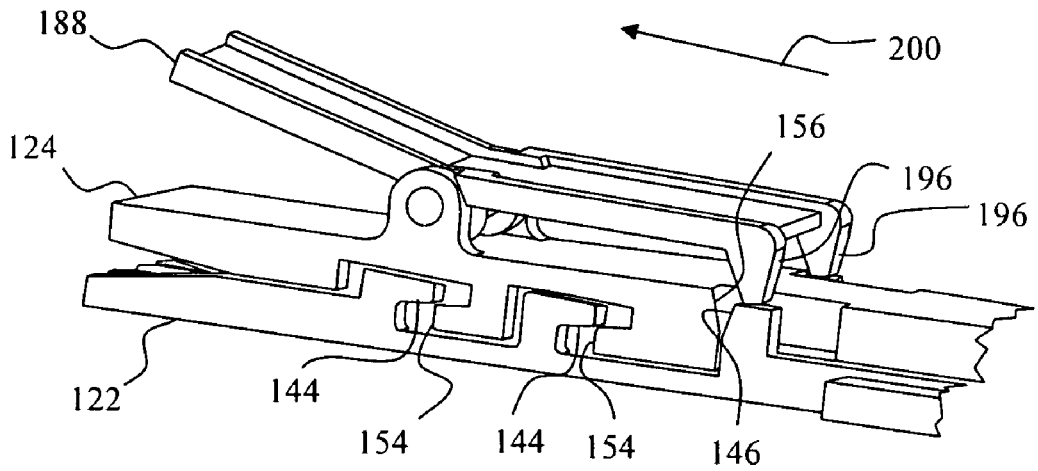
FIG. 4 depicts a partial side perspective view of the nose assembly of FIG. 2 without the base section showing the upper nose section lying on the lower nose section.

The upper nose section 124 is coupled with the lower nose section 122 by generally aligning the wedge walls 146 with the wedge walls 156. This allows the rearward facing wedges 154 to move past the forward facing wedges 144 so that the upper nose section 124 is fully supported by the lower nose section 122 as shown in FIG. 4. Once the upper nose section 124 is placed upon the lower nose section 122, the end portions of the upper nose section 124 and the lower nose section 122 located underneath the upper arm 192 define a cross section that is slightly smaller than the size of the opening 132.

The upper nose section 124 may then be moved in the direction of the arrow 200 in FIG. 4. This movement initiates a coupling between the rearward facing wedges 154 and the forward facing wedges 144. Thus, the lower nose section 122 and the upper nose section 124 form a nose piece 198. Additionally, a gap is generated between each opposing pair of the wedge walls 146 and the wedge walls 156. Once sufficient gaps are present, the lever 188, which is constantly biased to rotate in the clockwise direction as viewed in FIG. 4, rotates the spreading wedges 196 into the gaps between the wedge walls 146 and the wedge walls 156.

Figure 5:
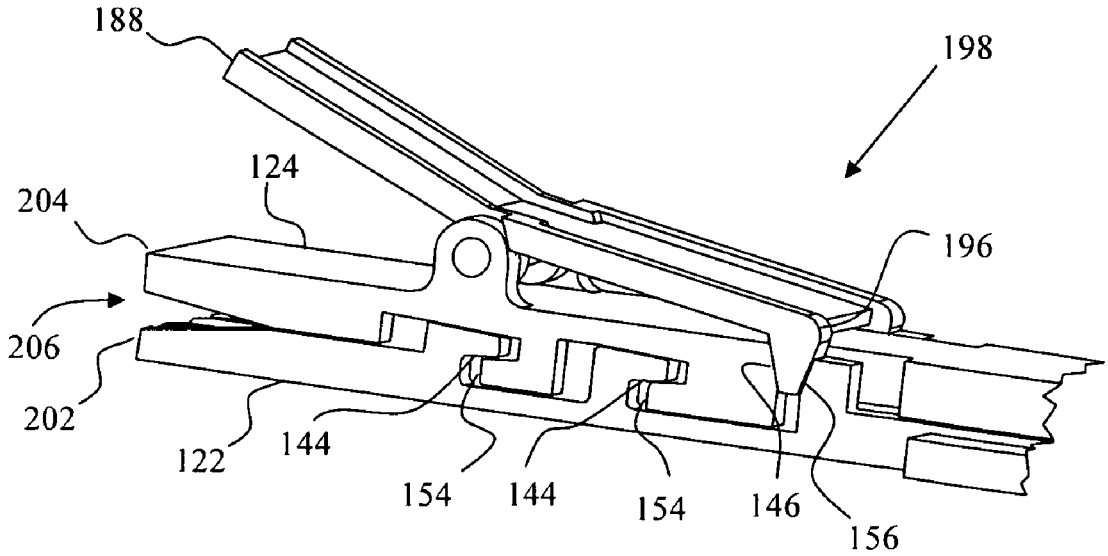
FIG. 5 depicts a partial side perspective view of the nose assembly of FIG. 2 without the base section showing the upper nose section in a locked coupled condition with the lower nose section and the spreading wedges of the lever positioned between opposing wedge walls of the lower nose section and the upper nose section.

The bias of the lever 188 forces the wedge walls 146 and the wedge walls 156 farther apart, thereby providing additional coupling between the rearward facing wedges 154 and the forward facing wedges 144 as shown in FIG. 5. As shown in FIG. 5, the end portions 202 and 204 of the lower nose section 122 and the upper nose section 124, respectively, define an opening, generally indicated by reference number 206, to a channel defined by the lower nose section 122 and the upper nose section 124 which is aligned with, and opens to, the channel port 164 shown in FIG. 2.

Figure 6:
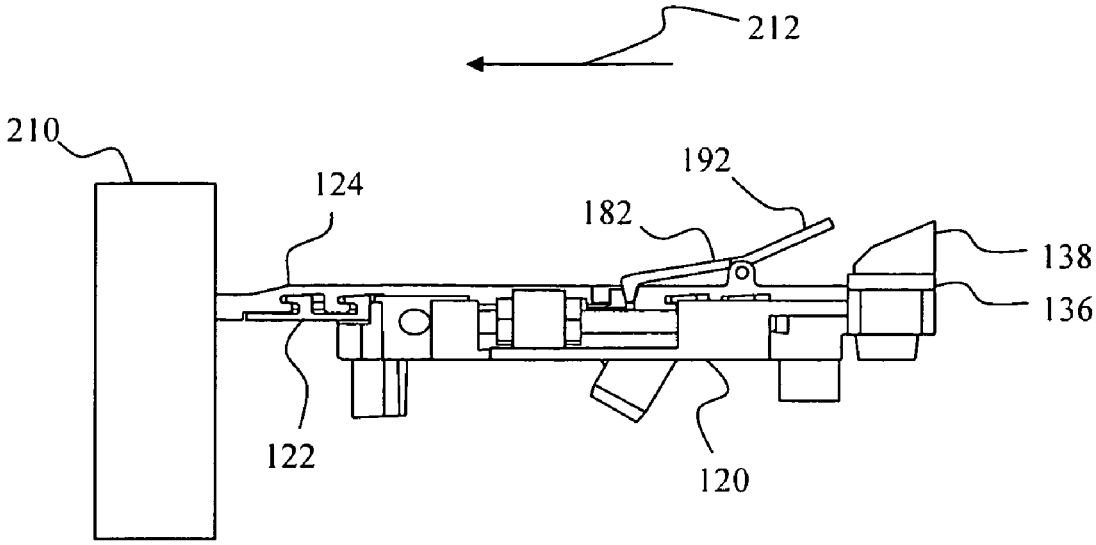
FIG. 6 depicts a side plan view of the nose assembly of FIG. 2 as the upper nose section of the nose assembly contacts a work piece.

Operation of the fastener impacting device 100 is described with reference to FIGS. 1, 3 and 5. An operator, after providing an energy source to the fastener impacting device 100 using the receptacle area 110, grasps the handle 106. The operator moves the fastener impacting device 100 toward a work piece 210 shown in FIG. 6 by moving the fastener impacting device 100 in the direction of the arrow 212. Initial contact with the work piece 210 is made by the upper nose section 124. Continued application of pressure forces the springs 170 against the spring stop 152 (see FIG. 3) generating a bias of the lower nose section 120 in a direction toward the work piece 210.

Biasing of the lower nose section 120 forces the rearward facing wedges 154 and the forward facing wedges 144 (see FIG. 5) toward a tighter coupling since the upper nose section 124 is immobilized by the work piece 210. As the springs 170 compress, the base 120 moves toward the work piece 210, causing relative movement between the lower nose section 122 and the bed 126. Thus, the nose piece 198 formed by the coupled lower nose section 122 and upper nose section 124 is received more deeply into the opening 132.

Figure 7:
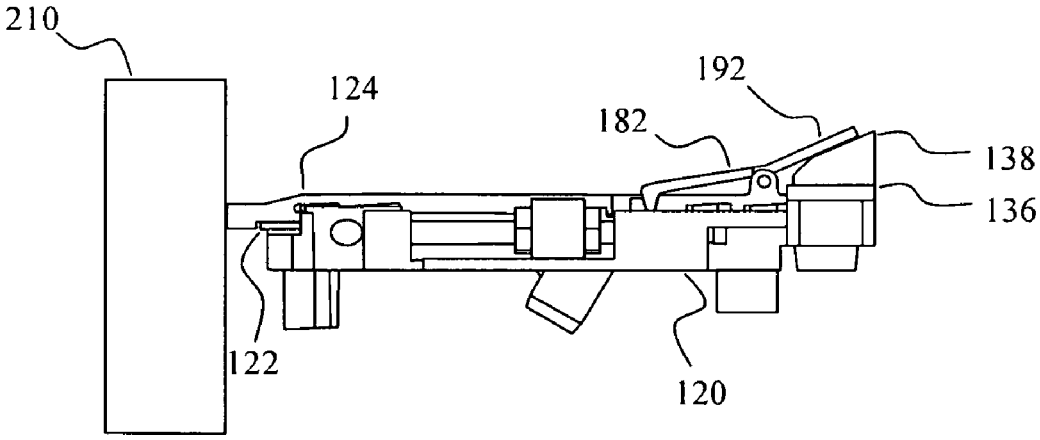
FIG. 7 depicts a side plan view of the nose assembly of FIG. 2 in a position whereat the angle between the upper arm of the lever and the upper surface of the upper nose section matches the angle defined by the ramps and the lower portion of the spreader such that the upper nose section and lower nose section have been received into an opening of the nose assembly spreader and the upper arm of the lever has come into contact with the ramps of the spreader as the nose assembly contacts a work piece, which causes a trigger disabling mechanism to be reconfigured.

Reception of the nose piece 198 into the opening 132 continues until the upper arm 192 of the lever 188 contacts the ramps 138 as shown in FIG. 7. Because the lever 188 is pivotably connected to the upper nose section 122 which is immobilized by the work piece 210, continued movement of the fastener impacting device 100 forces the ramps 138 against the upper arm 192 pushing the upper arm 192 in an upward direction as viewed in FIG. 7.

As the upper arm 192 is biased in the upward direction, upward movement of the nose piece 198 is restrained by the lower portion 136 of the spreader 134. Accordingly, the force applied to the upper arm 192 generates a bias on the spreading wedges 196. Thus, the constant bias of the lever 188, in the counterclockwise direction as viewed in FIG. 7, is augmented by the force of the ramps 138 against the upper arm 192. Accordingly, the coupled rearward facing wedges 154 and the forward facing wedges 144 are biased toward a locked condition as the spreading wedges 196 are pushed into the gap between the opposing wedge walls 146 and 156 (see FIG. 5).

When the nose piece 198 is in a locked coupled condition, the spreading wedges 196 are rotated into the gap between the opposing wedge walls 146 and 156 such that the upper arm 192 is pivoted to an angle with respect to the upper surface of the upper nose section 124 which allows the nose piece 198 to extend through the opening 132 to cause reconfiguration of a trigger disabling mechanism to a condition which allows the trigger 108 to initiate a firing sequence.

The trigger disabling mechanism (not shown) may be mechanically repositioned by the nose piece 198. Alternatively, a signal indicative of the position of one or more of the movable portions of the nose assembly 114 may be used to control reconfiguration of the trigger disabling mechanism. In a further embodiment, the trigger disabling mechanism electrically disables the trigger 108. In any event, once the angle between the upper arm 192 and the upper surface of the upper nose section 124 is equal to the angle defined by the ramps 138 and the lower portion 136 of the spreader 134, the nose piece 198 can be positioned with respect to the base 120 such that the trigger disabling mechanism enables initiation of a firing sequence by the trigger 108.

Once the trigger disabling mechanism no longer inhibits operation of the trigger 108, the operator initiates a firing sequence to impact a fastener by activating the trigger 108. In response, a fastener is driven along the channel defined by the lower nose section 122 and the upper nose section 124. The fastener is then driven through the channel port 164 and into the work piece 210. The depth to which the fastener is driven into the work piece 210 may be controlled by positioning of the depth control nut 174. Subsequently, the operator moves the fastener impacting device in a direction away from the work piece 210. This removes the compressive pressure from the springs 170 which then force the nose piece 198 along the bed 126 to an extended position whereat initiation of a firing sequence by the trigger 108 is again inhibited.

The upper nose section 124 and the lower nose section 122 may not be in a locked coupled condition when the upper arm 192 contacts the ramps 138. So long as the upper nose section 124 and the lower nose section 122 are coupled and the nose assembly 114 is not jammed, the additional force provided by the contact with the ramps 138 can force the upper nose section 124 and the lower nose section 122 into a locked coupled condition.

Figure 8:
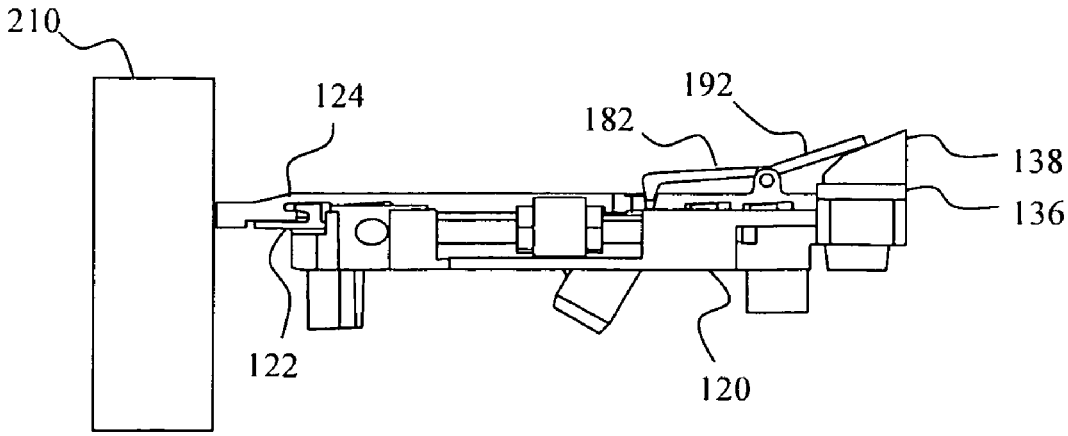
FIG. 8 depicts a side plan view of the nose assembly of FIG. 2 wherein the angle between the upper arm of the lever and the upper surface of the upper nose section does not match the angle defined by the ramps of the spreader and the lower portion of the spreader, thereby inhibiting movement of the upper nose section and lower nose section into an opening of the nose assembly spreader so that the trigger disabling mechanism is not reconfigured.

If, however, the upper nose section 124 and the lower nose section 122 are misaligned or the nose assembly 114 is jammed, the spreading wedges 196 will not be able to force the upper nose section 124 and the lower nose section 122 into a locked coupled condition. Accordingly, the angle formed between the upper arm 192 and the upper surface of the upper nose section 124 will be less than the angle defined by the ramps 138 and the lower portion 136 of the spreader 134 as depicted in FIG. 8.

Consequently, reception of the upper nose section 124 and the lower nose section 122 into the opening 132 is inhibited once the upper arm 192 contacts the ramps 138. The upper nose section 124 and the lower nose section 122 are thus inhibited from being positioned so as to cause reconfiguration of the trigger disabling mechanism to a configuration which allows the trigger 108 to be used to initiate a firing sequence.

The nose assembly 114 may be disassembled to clear a fastener which is stuck in the channel between the lower nose section 122 and the upper nose section 124. Disassembly of the nose assembly 114 is accomplished by first depressing the upper arm 192 of the lever 188. As the upper arm 192 is moved toward the upper surface of the upper nose section 124, the spreading wedges 196 are pivoted out of the gap between the opposing wedge walls 146 and 156.

Once the spreading wedges 196 are clear of the gap between the opposing wedge walls 146 and 156, the upper nose section 124 is forced in a direction away from the ramps 138. As described above, movement of the lower nose section 122 in the direction away from the ramps 138 is inhibited by the pin 182, which may be in the form of a screw or other removable component. As the lower nose section 122 contacts the pin 182, continued movement of the upper nose section 124 causes the rearward facing wedges 154 and the forward facing wedges 146 to de-couple. The upper nose section 124 may then be lifted off of the lower nose section 122 to clear the nose assembly 114.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A device for impacting a fastener comprising:

a trigger;

a trigger disabling mechanism changeable between a first condition wherein operation of the trigger is not disabled and a second condition wherein operation of the trigger is disabled;

a nose piece configured to change the trigger disabling mechanism from the second condition to the first condition, the nose piece including a first nose portion removably coupled to a second nose portion, the first nose portion and the second nose portion defining a channel therebetween through which a fastener is driven;

a spreader defining a spreader angle; and a lever, the lever pivotably attached to the nose piece and movable between a first position whereat the angle formed between an arm portion of the lever and an upper surface of the first nose section is less than the spreader angle and a second position whereat the angle formed between the arm portion of the lever and the upper surface of the first nose section is equal to the spreader angle.

2. The device of claim 1, wherein:

the nose piece is movable along a bed in a base between an extended position and a depressed position;

movement of the nose piece from the extended position to the depressed position causes reconfiguration of the trigger disabling mechanism from the second condition to the first condition; and movement of the nose piece from the extended position to the depressed position is inhibited when the lever is in the first position.

3. The device of claim 1, wherein:

the lever comprises a wedge portion configured to contact a first wall portion of the first nose portion and to contact a second wall portion of the second nose portion.

4. The device of claim 1, wherein the spreader comprises:

a lower surface positioned to contact an upper side of the first nose portion; and an upper surface spaced apart from the lower surface and positioned to contact the arm portion of the lever.

5. The device of claim 4, wherein:

the upper surface comprises at least one ramp; and the lower surface defines a portion of an opening, the opening sized to receive a portion of the nose piece therein.

6. A device for impacting a fastener comprising:

a trigger;

a trigger disabling mechanism changeable between a first condition wherein operation of the trigger is not disabled and a second condition wherein operation of the trigger is disabled; and a nose piece configured to change the trigger disabling mechanism from the second condition to the first condition, the nose piece including a first nose portion removably coupled to a second nose portion, the first nose portion and the second nose portion defining a channel therebetween through which a fastener is driven, wherein:

the first nose portion includes a first plurality of wedges opening toward a front portion of the first nose portion; and the second nose portion includes a second plurality of wedges opening toward a rear portion of the second nose portion.

7. A device for impacting a fastener comprising:

a nose assembly including a base portion, a first nose section configured to be slidably positioned on the base portion, and a second nose section removably coupled to the first nose section to move with the first nose section along the base, the first nose section and the second nose section defining a path along which a fastener is driven by the device;

a trigger mechanism for initiating a firing sequence; and a trigger disabling mechanism for disabling the trigger mechanism, the trigger disabling mechanism responsive to the position of the first nose section, such that when the first nose section is in a first position the trigger disabling mechanism disables the trigger mechanism and when the first nose section is in a second position the trigger disabling mechanism does not disable the trigger mechanism.

8. The device of claim 7, further comprising:

a spreader defining a spreader angle; and a lever, the lever pivotably attached to the second nose section and movable between a first position whereat the angle formed between an arm portion of the lever and an upper surface of the second nose section is less than the spreader angle and a second position whereat the angle formed between the arm portion of the lever and the upper surface of the second nose section is equal to the spreader angle.

9. The device of claim 8, wherein:

the first nose section is in an extended position with respect to the base in the first position and a depressed position in the second position; and movement of the first nose section from the extended position to the depressed position is inhibited when the lever is in the first position.

10. The device of claim 8, wherein:

the lever comprises a wedge portion configured to contact a first wall portion of the first nose section and to contact a second wall portion of the second nose section, the first wall portion opposing the second wall portion.

11. The device of claim 8, wherein the spreader comprises:

a first surface positioned to contact an upper side of the second nose section; and a second surface spaced apart from the first surface and positioned to contact the arm portion of the lever.

12. The device of claim 11, wherein:

the first surface defines a portion of an opening, the opening sized to receive a portion of the first nose section and the second nose section therein; and the second surface comprises a ramp.

13. The device of claim 8, wherein:

the first nose section includes a first plurality of wedges opening toward a front portion of the first nose section; and the second nose section includes a second plurality of wedges opening toward a rear portion of the second nose section.

14. A method of impacting a fastener comprising:

removably coupling a first nose section and a second nose section;

forming an angle with an arm of a lever of the nose section and the upper surface of the first nose section;

moving the coupled nose sections from a first extended position to a second depressed position whereat a first surface of a spreader of the nose section is in contact with the arm and a second surface of the spreader is in contact with the upper surface of the first nose section;

enabling operation of a trigger when the coupled nose sections are in the second position;

forcing a fastener along a channel formed by the coupled nose sections;

forming a gap between opposing wedge walls of the first nose section and the second nose section; and rotating a spreading wedge of the lever into the gap.

15. The method of claim 14, wherein moving the coupled nose sections comprises:

receiving a rear portion of the coupled nose sections into an opening defined at least in part by the spreader.

16. The method of claim 14, further comprising:

forcing the fastener through a channel port in the second nose section, the channel port aligned with the channel.

17. A method of impacting a fastener comprising:

removably coupling a first nose section and a second nose section;

forming an angle with an arm of a lever of the nose section and the upper surface of the first nose section;

moving the coupled nose sections from a first extended position to a second depressed position whereat a first surface of a spreader of the nose section is in contact with the arm and a second surface of the spreader is in contact with the upper surface of the first nose section;

enabling operation of a trigger when the coupled nose sections are in the second position; and forcing a fastener along a channel formed by the coupled nose sections, wherein removably coupling comprises:

engaging a first plurality of wedges on the first nose section with a second plurality of wedges on the second nose section.

* * * * *